US005805949A

United States Patent [19]

Nozawa et al.

[11] Patent Number: 5,805,949

[45] Date of Patent: Sep. 8, 1998

[54] PHOTOSENSITIVE MATERIAL PROCESSING APPARATUS

[75] Inventors: Ryouei Nozawa; Kazuyuki Kagawa; Koji Tashiro; Kazuyuki Akiyama, all of Kanagawa, Japan

[73] Assignee: Fuji Photo Film Co., Ltd., Kanagawa, Japan

[21] Appl. No.: 687,911

[22] Filed: Jul. 29, 1996

[30] Foreign Application Priority Data

Jul. 31, 1995 [JP] Japan ..... 7-195112

[51] Int. Cl.[6] ..... G03D 3/08

[52] U.S. Cl. ..... 396/612; 492/30; 492/50; 355/27; 396/614

[58] Field of Search ..... 396/583, 584, 396/612, 613, 620, 627, 33, 604; 355/27, 100, 406; 492/30, 50; 118/419

[56] References Cited

U.S. PATENT DOCUMENTS

| | | | |
|---|---|---|---|
| 4,319,827 | 3/1982 | Carter et al. | 396/583 |
| 4,714,943 | 12/1987 | Sakakibara et al. | 396/583 |
| 4,734,729 | 3/1988 | Hertzel et al. | 396/584 |
| 4,740,075 | 4/1988 | Schoerning | 396/614 |
| 4,768,434 | 9/1988 | Beery | 396/583 |
| 4,864,343 | 9/1989 | Nelson | 396/583 |
| 4,962,402 | 10/1990 | Ibuchi | 396/583 |
| 5,452,041 | 9/1995 | Claes et al. | 396/604 |

*Primary Examiner*—D. Rutledge
*Attorney, Agent, or Firm*—Sughrue, Mion, Zinn, Macpeak & Seas, PLLC

[57] ABSTRACT

A photosensitive material processing apparatus in which a pair of rollers respectively having water absorbing surface layers is disposed downstream of a washing processing section and the rotating shafts of said rollers are urged in the directions in which said rollers approach each other, wherein the thickness of said water absorbing surface layer of at least one roller of said rollers gradually decreases toward end portions of the at least one roller. In this way, since the thickness of the water absorbing surface layer of the at least one roller gradually decreases toward the end portions of said at least one roller, a gap is prevented from occurring between said water absorbing surface layer and said photosensitive material at the central portions of the rollers due to the flexing of the rollers.

16 Claims, 5 Drawing Sheets

PHOTOSENSITIVE MATERIAL PROCESSING APPARATUS

BACKGROUND OF THE INVENTION

1. Field of the Invention

The present invention relates to a photosensitive material processing apparatus having a water absorbing roller pair which removes the moisture or water from the surface of a photosensitive material for which developing, fixing and washing processes have been completed.

2. Description of the Related Art

Conventionally, an exposed photosensitive material is processed sequentially with such processing solutions as developing solution, fixing solution and washing or rinsing water or the like by a photosensitive material processing apparatus. Thereafter, the photosensitive material is finished by a drying process in the photosensitive material processing apparatus. Prior to entering the drying section, a water absorbing roller pair is usually provided to remove the excess water adhered to the surface of the photosensitive material.

For example, in the photosensitive material processing apparatus which processes the photosensitive material by sequentially immersing the photosensitive material in the developing solution, the fixing solution and the washing water, the water absorbing roller pair is disposed between a washing vessel containing the washing liquid and the drying section. The roller pair, while transporting the photosensitive material, absorbs the moisture or the liquid from the surface of the photosensitive material and feeds the photosensitive material to the drying section.

A pair of water absorbing rollers 170 is shown in FIG. 4, each roller of the roller pair having a shaft 172 and a sponge layer 174 which is formed by a foaming polyurethane or the like, and is mounted on the outer periphery of the shaft 172. The water absorbing rollers 170 are disposed such that the sponge layers 174 are pressed so as to contact each other by a predetermined force.

In the water absorbing rollers 170, however, as shown in FIG. 5, end portions 172A and 172B of the rotating shafts 172 of the rollers 170 are urged so as to approach each other (the direction of arrow E in FIG. 5).

Further, the rigidity of each of the rotating shafts depends upon the magnitude of the urging force so that the rotating shafts may be flexed.

When a photosensitive material 180 is clamped and transported between these water absorbing rollers 170, the rotating shafts 172 are increasingly flexed, so that the distance between the two rotating shafts 172 in the vicinity of central portions 170A of the water absorbing rollers 170 becomes larger. This phenomenon i.e., the flexing of the shafts, becomes more marked as the rigidity of each rotating shaft becomes lower, for example, the diameter thereof is reduced. For this reason, the gaps are caused between the photosensitive material 180 and the water absorbing surfaces of the water absorbing rollers 170, so that the surfaces of the water absorbing rollers can not sufficiently absorb the moisture or the liquid from the surface of the photosensitive material 180. As a result, there is a possibility that squeeze unevenness caused by the water absorbing rollers might occur.

SUMMARY OF THE INVENTION

In view of the above-described facts, it is an object of the present invention to provide a photosensitive material processing apparatus capable of eliminating the squeeze unevenness caused by water absorbing rollers.

According to a first aspect of the present invention, there is provided a photosensitive material processing apparatus in which a pair of rollers, each roller having a water absorbing surface layer, is disposed downstream of a washing processing section for washing a photosensitive material and each of rotating shafts of said rollers is urged in the direction in which the rollers approach each other, wherein the thickness of said water absorbing surface layer of at least one roller of said rollers gradually decreases toward end portions of said at least one roller.

Hence, in the photosensitive material processing apparatus according to the first aspect of the present invention, the rotating shafts of said rollers are urged in the direction in which the rollers approach each other, so that each rotating shaft is flexed. However, since the thickness of the water absorbing surface layer of the at least one roller of the rollers gradually decreases toward the end portions of the at least one roller of the rollers, a gap is prevented from occurring between each water absorbing surface layer and the photosensitive material. In addition, the cross-sectional configuration of each water absorbing surface layer can be determined on the basis of the flexing amount of each rotating shaft or the like.

According to a second aspect of the present invention, there is provided a photosensitive material processing apparatus having a processing section for processing said photosensitive material with a processing solution, and a drying section for drying said photosensitive material which has been processed with said processing solution, comprising: a pair of rollers which is disposed between said processing section and said drying section and is urged in the directions in which the rollers approach each other, said photosensitive material which has been processed with said processing solution being clamped and transported to said drying section by said rollers; and a rotating shaft and a water absorbing surface layer mounted on the outer periphery of said rotating shaft constituting each roller of said rollers, wherein the thickness of said water absorbing surface layer of at least one roller of said rollers gradually decreases from the central portion of the axial direction of said rotating shaft toward end portions of said axial direction thereof.

DESCRIPTION OF THE EMBODIMENT

With reference to the accompanying drawings, a description of an automatic developing device 10 serving as a photosensitive material processing apparatus of the present invention will be given in detail hereinafter. The automatic developing device 10 is structured such that a film 20 serving as a photosensitive material for which developing, fixing and washing processings have been completed is finished by drying processing.

Figure 3:
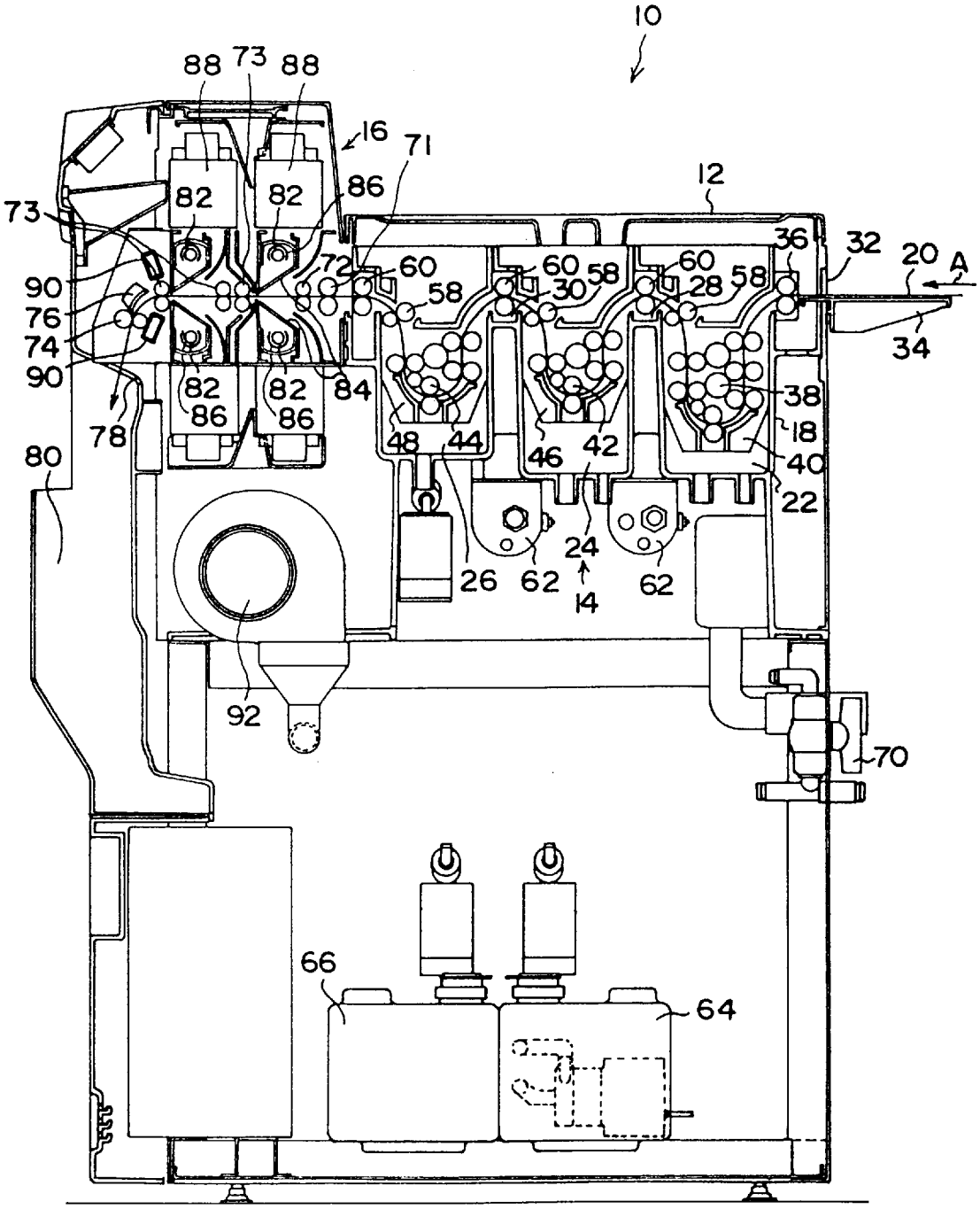
FIG. 3 is a schematic overall view of an automatic development apparatus using an embodiment of the present invention.
Figure 4:
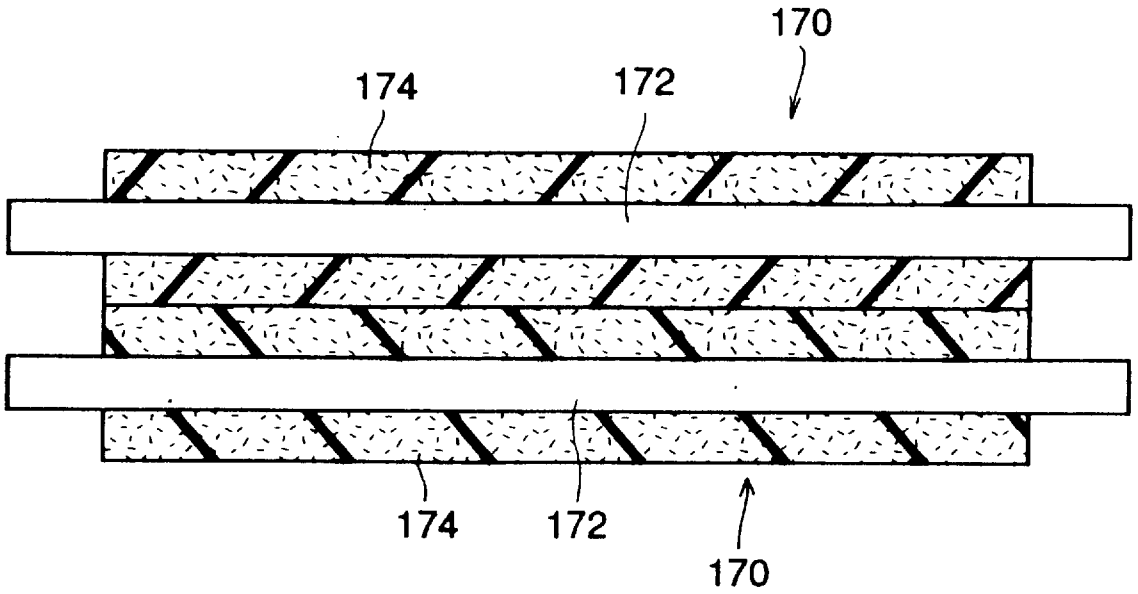
FIG. 4 PRIOR ART
FIG. 4 is a front view illustrating a state in which no urging force is imparted to a roller pair of the prior art.
Figure 5:
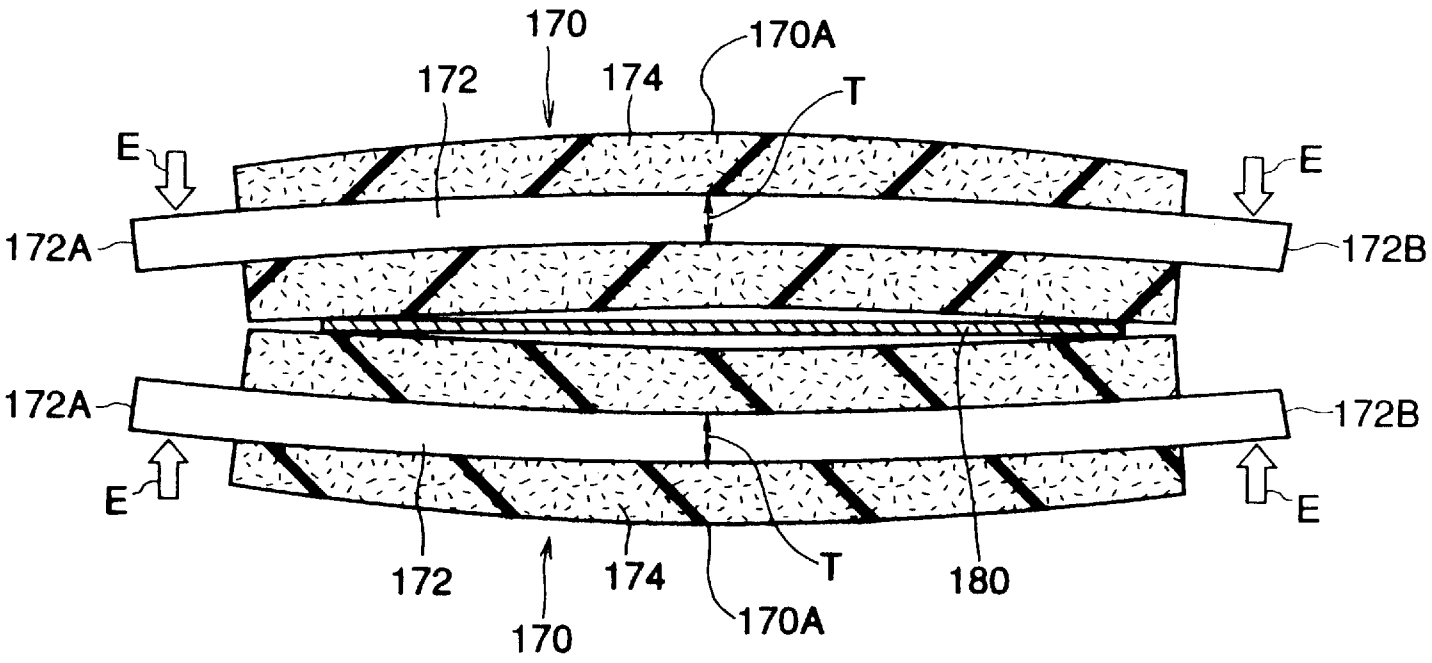
FIG. 5 PRIOR ART
FIG. 5 is a front view illustrating a state in which urging force is imparted to a roller pair of the prior art.

As illustrated in FIG. 3, a machine frame 12 of the automatic developing device 10 is provided with a processing section 14 for processing the film 20 with processing solutions and a drying section 16 for drying the film 20 which has been processed with the processing solutions. The processing section 14 has a processing unit 18 which includes a developing tank 22, a fixing tank 24, and a washing tank 26 along the transporting direction of the film 20 (i.e., the direction indicated by the arrow A in FIG. 3). Further, rinsing tanks (i.e., cleaning tanks) 28, 30 are provided between the developing tank 22 and the fixing tank 24 and between the fixing tank 24 and the washing tank 26, respectively. The processing unit 18 is resin-molded as a single unit.

The machine frame 12 of the automatic developing device 10 has an insertion table 34 which projects outwardly from an insertion port 32 into which the film 20 is inserted. Further, an insertion roller pair 36 is disposed inside of the insertion port 32 and is able to nip and draw the film 20 which is placed on the insertion table 34 and which is inserted from the insertion port 32. Moreover, an auto-feeder or the like can be used instead of the insertion table 34 in order to automatically insert the film 20 into the insertion port 32.

The developing tank 22 accommodates a developing solution into which a developing rack 40 is immersed. The developing rack 40 has transport rollers 38 which are driven by a motor (not shown) so as to transport the film 20. Further, the fixing tank 24 accommodates a fixing solution and the washing tank 26 accommodates a washing water (i.e., washing liquid). A fixing rack 46 and a washing rack 48 having transport rollers 42, 44, each of which is driven by a motor (not shown) for transporting the film 20, are respectively immersed in the fixing solution and the washing water. The developing solution, the fixing solution and the washing water serve as the processing solutions, respectively.

Cross-over rollers 60 and film guides are disposed between the developing tank 22 and the fixing tank 24, between the fixing tank 24 and the washing tank 26, and between the washing tank 26 and the drying section 16 so that the film which has been processed at the respective upstream tanks can be fed into the respective downstream tanks or the drying section.

A plurality of roller pairs 58, 60 are disposed at the outlet of each tank so as to pull out the film 20 from each processing solution within each tank. The roller pairs 58, 60 also squeeze each processing solution adhered to the film 20.

These rollers are rotated by the driving force transmitted from the driving source (not shown) and transport the film 20 at a constant rate synchronous with the rotations of the rollers on the developing rack 40, the fixing rack 46 and the washing rack 48.

Further, heat exchanging devices 62 are disposed below the processing unit 18. The developing solution in the developing tank 22 and the fixing solution in the fixing tank 24 are fed to the heat exchanging devices 62 and subjected to heat-exchange. Thereafter, these solutions are returned to the developing tank 22 and the fixing tank 24, so that the developing solution in the developing tank 22 and the fixing solution in the fixing tank 24 are always maintained within the temperature at which the film 20 can be processed in an optimal state.

The automatic developing device 10 is also provided with replenishing containers 64, 66 which accommodate developing replenisher and fixing replenisher supplied to the developing tank 22 and the fixing tank 24 according to the degradations of the developing solution in the developing tank 22 and the fixing solution in the fixing tank 24.

The roller pairs 60 transport the film 20, which has been processed in each of the developing tank 22, the fixing tank 24 and the washing tank within the processing section 14, to the drying section 16 in the vicinity of the processing section 14.

As illustrated in FIG. 3, a roller pair 71 is disposed at the inlet portion of the drying section 16 and absorbs the washing water or the processing solution.

Figure 1:
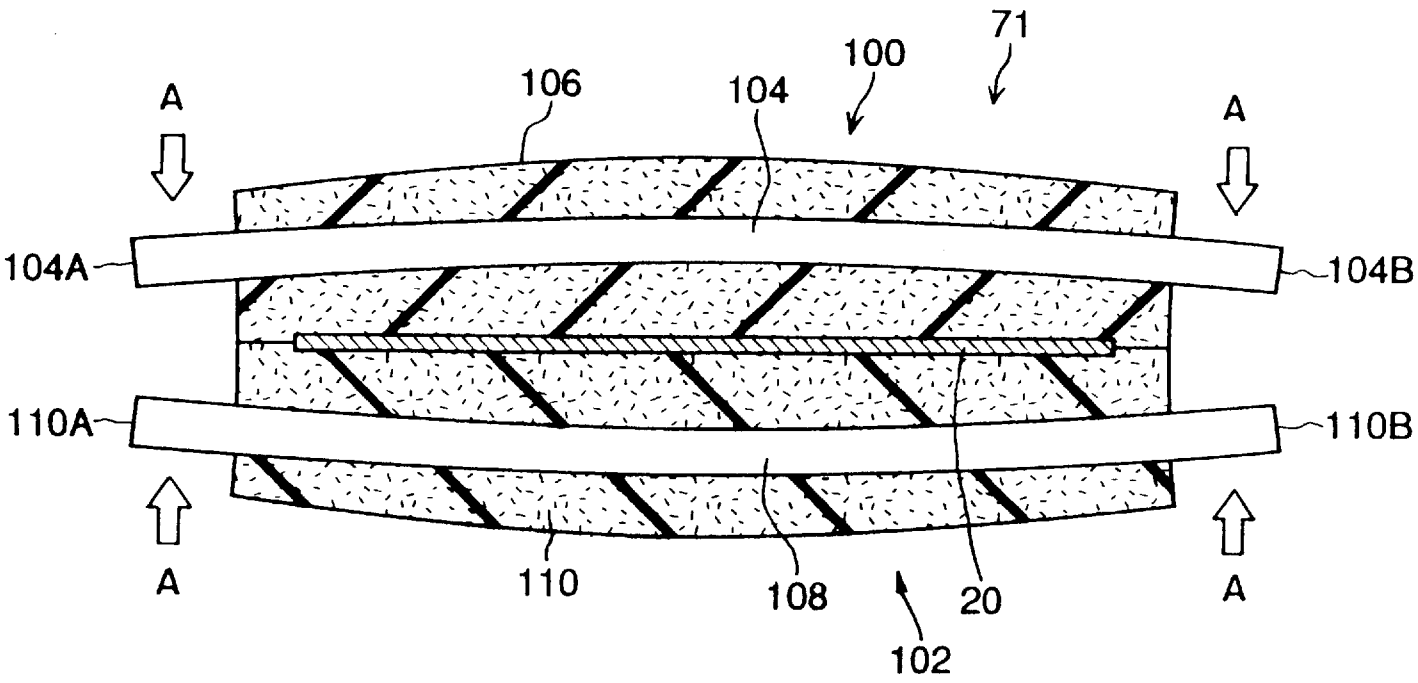
FIG. 1 is a front view illustrating a state in which urging force is imparted to a roller pair according to an embodiment of the present invention.

As illustrated in FIG. 1, the roller pair 71 includes a pair of water absorbing rollers 100, 102. The water absorbing rollers 100, 102 respectively include stainless steel shafts 104, 108 of 7.5 mm diameter, which serve as rotating shaft members and coating layers 106, 110 (full length: 450 mm, maximum outer diameter: 20.0 mm) mounted on the outer periphery of the shaft 104 and serve as water absorbing surface layers made of 'RUBYCELL' (i.e., a product name of a foaming polyurethane available from Toyo Polymer Co., Ltd.).

Urging forces of urging means such as spring means or the like are applied to end portions 104A, 104B of the shaft 104 and end portions 110A, 110B of the shaft 108 in the direction where the rotating shafts 104 and 108 approach each other (i.e., the directions of the arrows A in FIG. 1).

Figure 2:
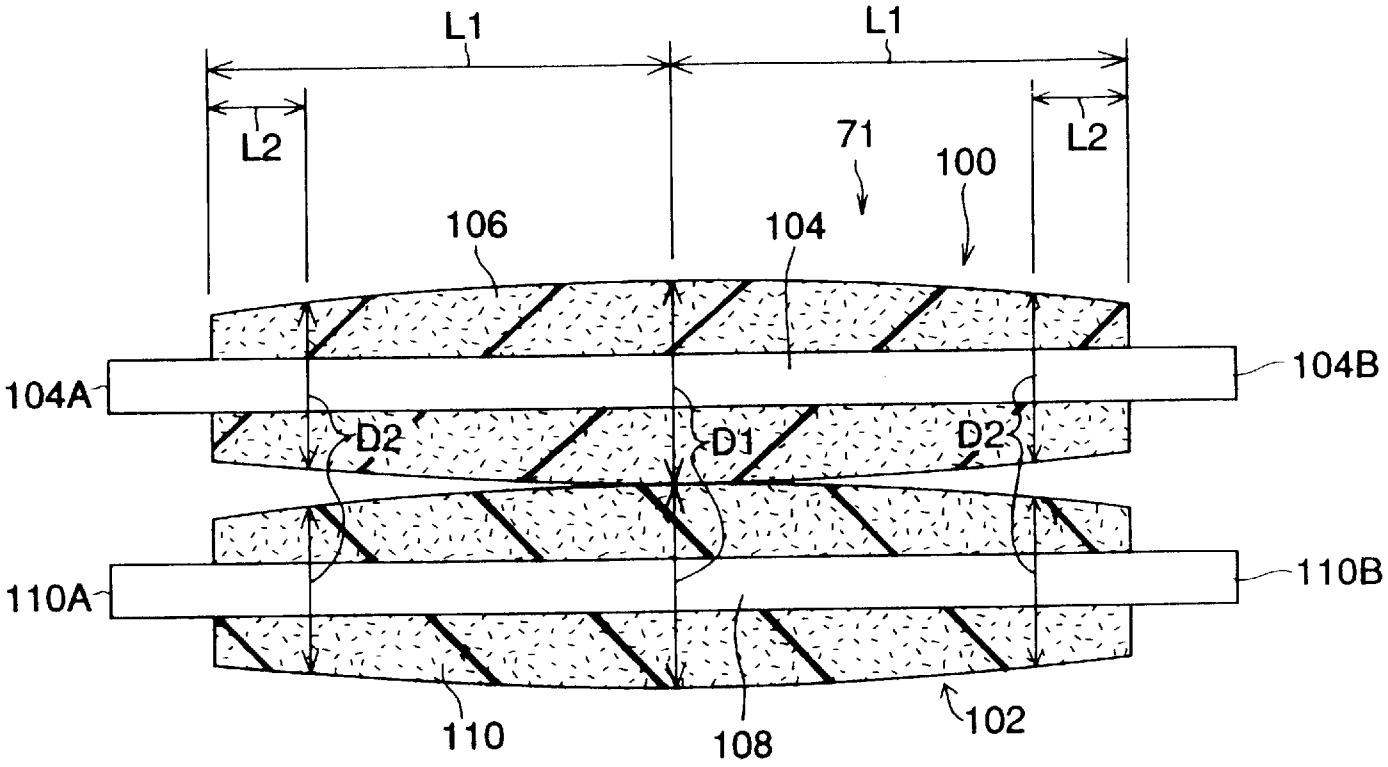
FIG. 2 is a front view illustrating a state in which urging force is not imparted to a roller pair according to an embodiment of the present invention.

As illustrated in FIG. 2, in a case in which no urging force is imparted to the shafts 104, 108, each of the shafts 104, 108 is kept straight and the thickness of each of the coating layers 106, 110 serving as a water absorbing surface layer is reduced along the longitudinal direction of the shaft from the central portion of the roller toward end portions thereof, that is, each coating layer has a so-called crown configuration.

For example, the difference between the maximum outer diameter (D1=20.0 mm) of the central portion (L1=225 mm) in the longitudinal direction of each of the coating layers 106, 110 and the outer diameter D2 of each portions positioned at a predetermined length (distance) L2 (L2=20 mm) from the end portions of the coating layers 106, 110 can be represented by the equation D1−D2=0.10 mm, and the difference is preferably set to a value between 0.05 mm and 0.15 mm.

Therefore, when the urging forces of the spring means are applied to the end portions 104A, 104B of the shaft 104 and the end portions 110A, 110B of the shaft 108, the shafts 104, 108 are flexed respectively as shown in FIG. 1. If each of the coating layers would have no crown configuration, this flexing causes a gap between the film 20 and the central portion of the longitudinal direction of each coating layer. However, the elasticity and the crown configuration that the afore-mentioned RUBYCELL coating layers 106, 110 have is able to prevent the gap from occurring in such a manner as described above.

As illustrated in FIG. 3, a transport path along which the film 20 is transported in a substantially horizontal direction by a roller pair 72, 73 and substantially downwardly by a roller pair 74 and a guide 76 is formed in the drying section 16. At the downstream end of the transport path, a discharge port 78 is provided for outputting the film 20 into an accommodating box 80 mounted on the machine frame 12.

A plurality of infrared heaters 82 are disposed above and below the transport path for transporting the film 20 in the horizontal direction in the drying section 16. Each of the infrared heaters 82 irradiates infrared rays substantially uniformly in the transverse direction of the film 20. A guide 84 formed by a stainless steel wire is provided between the transport path and each of the infrared heaters 82 so as to extend in the transverse direction of the film 20. Reflecting mirrors 86 are respectively disposed on the rear sides of the infrared heaters 82. As a result, the film 20 can be prevented from approaching the infrared heaters 82 to be burnt, while it is being transported on the transport path, and the heat, or rays, radiated from the infrared heater 82 can effectively be directed by the reflected mirrors 86 to the surface of the film 20 through the guide 84 so as to heat and dry the film 20.

Fans 88 are provided on the back sides of the reflecting mirrors 86 in the drying section 16. The fans 88 suck in the outside air from the machine frame 12 as drying air and blow out the air to the surface of the film outside of the reflecting mirrors 86 of the infrared heaters 82. The drying air removes the moisture which is evaporated from the film 20 from the space around the surface of the film 20 and maintains the surface temperature of the film 20 heated by the infrared heaters 82 within a predetermined temperature range.

Further, blow-out pipes 90 are located at both sides of the transport path of the film 20 in the vicinity of the rollers 74 and the guide 76. The outside air as the drying air is supplied to the blow-out pipes 90 via a fan 92. The blow-out pipes 90 discharge the drying air toward the film 20 and remove the high moisturized air generated from the surface of the film 20 which is being transported between the roller 74 and the guide 76, so that the drying of the film 20 can be promoted.

Next, a description will be given of the operation of the present embodiment.

In the automatic developing apparatus 10, when the film 20 is inserted from the insertion portion 32, the film 20 is drawn into the apparatus by the insertion rollers 36 and fed into the developing tank 22. After the film 20 has been transported and developed while it is being immersed in the developing solution in the developing tank 22 by the developing rack 40, the developing solution adhered to the surface of the film 20 is squeezed by the roller pairs 58, 60.

The film 20 for which the developing processing has been completed is transported into the fixing tank 24 and transported into the fixing tank 24 wherein the film 20 is transported into the fixing tank 24 which it is being immersed in the fixing solution. After the fixing processing of the film 20 has been performed, the fixing solution adhered to the film 20 is squeezed in the same manner as the film 20 in the developing tank 22.

The film 20 for which the developing and fixing processings have been completed is washed in the washing water as being transported by the washing rack 48 and then the film 20 is guided into the drying section 16 by the roller pairs 58, 60. At this time, the washing water adhered to the surface of the film 20 is absorbed by the water absorbing surface layers of the water absorbing roller pair 71 provided at the entrance portion of the drying section 16 and the film 20 is then transported to the drying section 16.

Hence, in the automatic developing apparatus 10 of the present embodiment, the roller pair 71 has the water absorbing surface layers 106, 110 which are formed in the crown configuration, so that the urging forces due to the spring means are applied to the end portions 104A, 104B of the shaft 104 and the end portions 110A, 110B of the shaft 108. As a result, the gap can be prevented from being produced between these surface layers and the film 20 even if the shaft 104 and the shaft 108 are flexed as shown in FIG. 1, when the film 20 is clamped and transported by the roller pair 71.

Accordingly, since the surface layers of the roller pair 71 are able to sufficiently absorb the excess water adhered to the surface of the film, unevenness caused to the film by the rollers can be eliminated, so that degradation of the image quality can be prevented.

In the drying section 16, the film 20 is heated and dried by the heat from the infrared heaters 82 as being transported by the roller pair 72. If the drying section 16 is constituted such that a portion of the drying air is directly introduced into the roller pair 71 from the fans 88, the excess water adhered to the surface layers of the roller pair 71 can be evaporated more effectively. The film 20 thus dried is transported to the discharging port 78 by the roller pair 74 and the guide 84, and discharged into the accommodation box 80.

Further, according to the present embodiment of the present invention, although both of the surface layer 106 and the surface layer 110 are formed in the crown configuration, only one of these layers may be formed in the crown configuration. Moreover, although the water absorbing roller pair of the present invention is disposed only at the entrance of the drying section 16 in the present embodiment, the roller pair can also be used instead of the cross-over roller pair 60 disposed at each of the developing tank 22, the fixing tank 24 and the washing tank 26 within the processing unit 18.

A reproducing photosensitive material to which the water absorbing roller pair of the present invention is applied is not limited to the film. For example, the roller pair according to the present invention can be applied to other photosensitive materials such as photographic printing paper, photolithography or the like.

What is claimed is:

1. A photosensitive material processing apparatus in which a pair of rollers is disposed downstream and outside of a washing processing section, each roller of the pair having a rotating shaft and a water absorbing layer on the shaft, urged in the directions in which the rollers approach each other, wherein the thickness of said water absorbing surface layer of at least one roller of said rollers gradually decreases toward end portions of said at least one roller.

2. A photosensitive material processing apparatus according to claim 1, wherein the thicknesses of said water absorbing surface layers of the rollers gradually decrease toward the end portions of the rollers.

3. A photosensitive material processing apparatus according to claim 1, wherein the rollers are urged through end portions of the rotating shafts.

4. A photosensitive material processing apparatus according to claim 1, wherein said water absorbing surface layer of said at least one roller has a crown configuration.

5. A photosensitive material processing apparatus according to claim 2, wherein said water absorbing surface layers of the rollers have crown configurations.

6. A photosensitive material processing apparatus according to claim 1, wherein said water absorbing surface layer is made from foaming polyurethane.

7. A photosensitive material processing apparatus according to claim 1, wherein said water absorbing surface layer has elasticity and said rotating shaft has flexibility.

8. A photosensitive material processing apparatus which is provided with a processing section for processing said photosensitive material with a processing solution, and a drying section for drying said photosensitive material which has been processed with said processing solution, comprising:

a pair of rollers which is disposed between said processing section and said drying section such that said pair of rollers is disposed downstream and outside of said processing section and urged in the directions in which the rollers approach each other, said photosensitive material which has been processed with said processing solution being clamped and transported to said drying section by said rollers; and a rotating shaft and a water absorbing surface layer mounted on the outer periphery of said rotating shaft constituting each roller of said rollers, wherein the thickness of said water absorbing surface layer of at least one roller of said rollers gradually decreases from the central portion of the axial direction of said rotating shaft toward end portions of said axial direction thereof.

9. A photosensitive material processing apparatus according to claim 8, wherein the thicknesses of said water absorbing surface layers of both of said rollers gradually decrease from the central portions of the axial directions of said rotating shafts toward end portions of said axial directions thereof.

10. A photosensitive material processing apparatus according to claim 8, wherein said rollers are urged at the end portions of said rotating shafts.

11. A photosensitive material processing apparatus according to claim 9, wherein said water absorbing surface layers of said rollers have crown configurations.

12. A photosensitive material processing apparatus according to claim 8, wherein said water absorbing surface layer is made from foaming polyurethane.

13. A photosensitive material processing apparatus according to claim 8, wherein said processing section is a washing tank and said processing solution is washing liquid.

14. A photosensitive material processing apparatus according to claim 8, wherein said photosensitive material is a photographic film.

15. A photosensitive material processing apparatus according to claim 8, wherein said photosensitive material processing apparatus is an automatic developing apparatus.

16. A photosensitive material processing apparatus according to claim 8, wherein said water absorbing surface layer has elasticity and said rotating shaft has flexibility.

* * * * *